US007850038B2

(12) United States Patent
Mueller et al.

(10) Patent No.: US 7,850,038 B2
(45) **Date of Patent: *Dec. 14, 2010**

(54) SCENTED CONTAINER

(75) Inventors: Joerg Mueller, Karben (DE); Yessica De Nardin, S. Giovanni Teatino Chieti (IT); Ursula Christina Glaser, Wiesbaden (DE); Robert M. Hubbard, Mason, OH (US); Lamia Delphine Mimassi, Ixelles (BE); Cornelia Schmidt, Bad Soden am Taunus (DE); Naka Seidel, Frankfurt am Main (DE)

(73) Assignee: The Procter & Gamble Company, Cincinnati, OH (US)

( * ) Notice: Subject to any disclaimer, the term of this patent is extended or adjusted under 35 U.S.C. 154(b) by 406 days.

This patent is subject to a terminal disclaimer.

(21) Appl. No.: 11/710,218

(22) Filed: Feb. 23, 2007

(65) Prior Publication Data

US 2009/0082247 A1 Mar. 26, 2009

(51) Int. Cl.
*A47K 10/24* (2006.01)

(52) U.S. Cl. ..... 221/45

(58) Field of Classification Search ..... 221/45
See application file for complete search history.

(56) References Cited

U.S. PATENT DOCUMENTS

| | | | | |
|---|---|---|---|---|
| 4,515,909 | A | 5/1985 | Sawano et al. | |
| 4,761,437 | A | 8/1988 | Christie | |
| 4,849,415 | A | 7/1989 | Zweigle | |
| 4,865,221 | A | 9/1989 | Jackson et al. | |
| 5,109,029 | A | 4/1992 | Malone | |
| 5,582,294 | A | 12/1996 | Yamada | |
| 5,707,696 | A | 1/1998 | Boxler | |
| 5,750,611 | A | 5/1998 | Trouilhet | |
| 5,861,128 | A | 1/1999 | Vick et al. | |
| 6,063,365 | A | 5/2000 | Shefer et al. | |
| 6,291,371 | B1 | 9/2001 | Shefer et al. | |
| 6,334,974 | B1 | 1/2002 | Chen | |
| 6,426,055 | B1 | 7/2002 | Shefer et al. | |
| 6,703,011 | B2 | 3/2004 | Shefer et al. | |
| 6,716,805 | B1 | 4/2004 | Sherry et al. | |
| 6,902,077 | B1 | 6/2005 | Tack et al. | |
| 7,304,025 | B2 * | 12/2007 | Hardy et al. | 510/439 |
| 2002/0037385 | A1 | 3/2002 | Pignot et al. | |
| 2002/0086804 | A1 | 7/2002 | Shefer et al. | |
| 2002/0103086 | A1 | 8/2002 | Asrar et al. | |
| 2003/0105183 | A1 | 6/2003 | Sharak | |
| 2003/0126709 | A1 | 7/2003 | Policicchio et al. | |
| 2003/0195272 | A1 | 10/2003 | Harwell et al. | |
| 2004/0018278 | A1 | 1/2004 | Popplewell et al. | |
| 2004/0018293 | A1 | 1/2004 | Popplewell et al. | |
| 2004/0110648 | A1 | 6/2004 | Jordan, IV et al. | |
| 2005/0076533 | A1 | 4/2005 | Huston et al. | |

(Continued)

FOREIGN PATENT DOCUMENTS

EP 0664317 A1 7/1995

(Continued)

*Primary Examiner*—John R Hardee
(74) *Attorney, Agent, or Firm*—Thibault Fayette

(57) ABSTRACT

A container may comprise a source comprising a fragrance composition. The fragrance composition may diffuse from the source into an article-receiving cavity of the container. The fragrance composition may transfer to the contents of the container.

18 Claims, 5 Drawing Sheets

U.S. PATENT DOCUMENTS

| | | | | |
|---|---|---|---|---|
| 2005/0081888 | A1 | 4/2005 | Pung et al. | |
| 2005/0106200 | A1 | 5/2005 | Corzani et al. | |
| 2005/0125923 | A1 | 6/2005 | Benjamin et al. | |
| 2005/0129743 | A1 | 6/2005 | Benjamin et al. | |
| 2005/0139598 | A1 | 6/2005 | Tack et al. | |
| 2005/0192201 | A1* | 9/2005 | Ford et al. | 510/438 |
| 2005/0192207 | A1 | 9/2005 | Morgan et al. | |
| 2005/0272624 | A1 | 12/2005 | Hardy et al. | |
| 2005/0272878 | A1 | 12/2005 | Corzani et al. | |
| 2006/0003654 | A1* | 1/2006 | Lostocco et al. | 442/149 |
| 2006/0177488 | A1 | 8/2006 | Caruso et al. | |

FOREIGN PATENT DOCUMENTS

| | | | |
|---|---|---|---|
| EP | 0534600 | B1 | 5/1996 |
| EP | 0483126 | B1 | 3/1997 |
| EP | 0740684 | B1 | 9/1999 |
| EP | 0985417 | A2 | 3/2000 |
| EP | 0744357 | B1 | 10/2000 |
| WO | WO 1999/27910 | | 6/1999 |
| WO | WO 02/066084 | A1 | 8/2002 |
| WO | WO 2004/020566 | A1 | 3/2004 |
| WO | WO 2005/005591 | A1 | 1/2005 |

* cited by examiner

SCENTED CONTAINER

FIELD

In an embodiment, the invention relates to a container. The container may comprise at least one source comprising a fragrance composition. The fragrance composition may diffuse into the container's article-receiving cavity. The fragrance composition may transfer to the container's contents.

BACKGROUND

A wide variety of consumer articles rely on fragrance compositions to enhance their appeal. Often the level of fragrance needed in an article to achieve significant human response is very low. This is particularly true for a fragrance that has a high tendency to diffuse under normal atmospheric conditions (high vapor pressure) and has a low odor threshold (high odor activity). Due to their nature, however, these fragrances are often lost during the stress of processing and/or distribution that occur during the chain of production. Attempts have been made to compensate for these losses by over-dosing the desired fragrance component. This technique, however, may be undesirable as it may contribute to an increased cost of production, overuse of the fragrance composition, and a longer-lasting scent that may be unpleasant to the user.

Lotion compositions on substrates, including wet wipes, contain many types of components which may generally fall into the category of fragrance compositions. Challenges may arise when there is a desire to change from production of an article incorporating a particular fragrance composition to an article incorporating a different fragrance composition. The production line generally has to be completely shut down and thoroughly cleaned prior to the introduction of the different fragrance composition in order to avoid cross-contamination of fragrance compositions. This may be costly for the manufacturer as time to produce articles is lost when a production line is shut down.

The lotion composition may incorporate an over-dosed amount of a fragrance. This over-dosing may allow the fragrance to be delivered to the user's skin, via the lotion, to provide an olfactory aesthetic benefit and to serve as a signal to the user that the skin is clean. The lotion composition, however, may remain on the skin for a lengthy period of time before either being absorbed by the skin or evaporating from the skin. The fragrance, therefore, also remains on the skin. While a user responds initially to the fragrance as a signal of cleanliness, the prolonged duration of the fragrance may serve as a continued reminder of the cleaning process. For example, if the user utilized the wipes in a diaper change, the initial scent of the fragrance may trigger a signal that the skin is clean. A prolonged exposure to the fragrance due to over-dosing of the fragrance in the composition, however, may continue to remind the user of the unpleasant task of the diaper change. A prolonged exposure to the fragrance may also result in olfactory adaptation in which the user becomes desensitized to the fragrance and may no longer respond to the fragrance as a signal of cleanliness.

It would be beneficial to provide a container comprising a fragrance composition in which the fragrance composition could be transferred to the contents of the container. It would be beneficial to provide a container comprising a fragrance composition in which the fragrance may be detected by the user each time the container is opened.

SUMMARY

A container comprising a container body comprising a wall. The body defines an article-receiving cavity. The wall has an interior surface facing the article-receiving cavity. A source may be associated with a portion of the interior surface. The source may releasably comprise a fragrance composition. The fragrance composition may diffuse from the source into the article-receiving cavity.

The fragrance composition may comprise materials such as, but not limited to, aldehydes, ketones, alcohols, benzoids, esters and combinations thereof. The fragrance composition may comprise materials such as, but not limited to, aromatherapy adjuvants, natural materials and combinations thereof.

The source may be a hot melt adhesive. The hot melt adhesive may comprise a copolymer of ethylene with at least another monomer comprising at least one heteroatom and greater than about 10% of a plasticizer comprising at least one heteroatom.

DETAILED DESCRIPTION

A container may comprise a source releasably comprising a fragrance composition. The fragrance composition may provide a pleasant smell each time the container is opened. The fragrance composition may diffuse into the article-receiving cavity of the container and may also transfer to the contents of the container.

The term "flexible" means herein that the material may tend to conform or deform in the presence of externally applied forces.

The term "fragrance" refers herein to the odor of perfume, cologne or toilet water.

The term "nonwoven" refers herein to a fibrous structure made from an assembly of continuous fibers, co-extruded fibers, non-continuous fibers and combinations thereof, without weaving or knitting, by processes such as spunbonding, carding, meltblowing, airlaying, wetlaying, coform, or other such processes known in the art for such purposes. The nonwoven structure may comprise one or more layers of such fibrous assemblies, wherein each layer may include continuous fibers, coextruded fibers, noncontinuous fibers and combinations thereof.

The term "substrate" refers herein to a piece of material, generally nonwoven material, such as a sheet, used in cleaning or treating various surfaces, such as food, hard surfaces, inanimate objects, body parts, etc. The substrate may also be a material such as a tissue or paper towel. The substrate may be wet or dry.

The term "wet" refers herein to a material, such as a nonwoven substrate, having a moisture content of greater than about 10% by weight of the material. Such materials often have a moisture content of about 50% to about 400%, 800% or more by weight of the material. This is in contrast to a "dry" material which is used herein to indicate a material having a moisture content of less than about 10% by weight of the material.

Container

A container may have any shape suitable for containing its articles, such as a stack or roll of substrates, such as nonwoven substrates. The shape may be cylindrical, polygonal, spherical or parallelepipedic.

Figure 1:
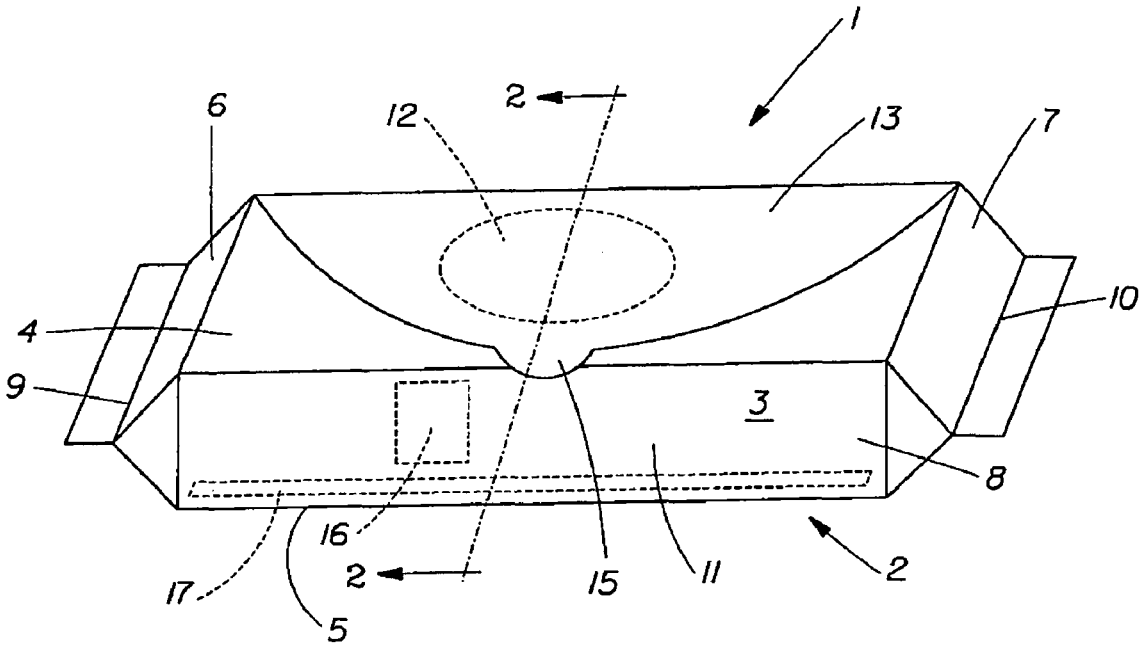
FIG. 1 is a perspective view of a container in a closed configuration.
Figure 2:
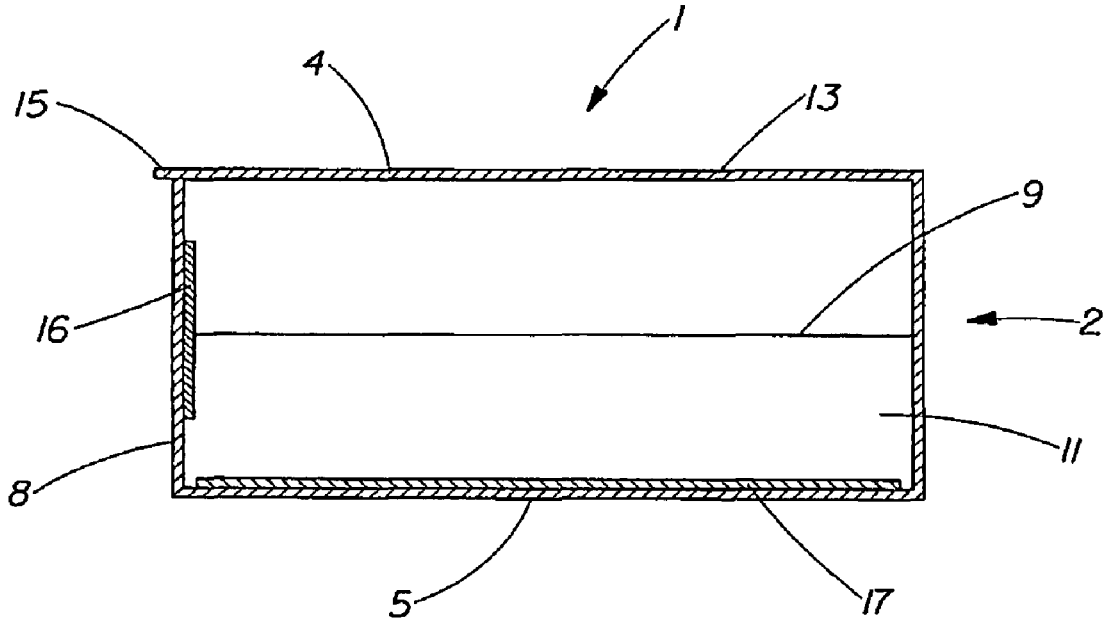
FIG. 2 is a cross-section view of the container of FIG. 1 taken along section line 2-2.

FIG. 1 illustrates a container 1 associated with a source 16. The container 1 may comprise a body portion 2 comprising a flexible polymeric sheet 3. The body portion 2 may comprise walls such as a top wall 4, opposed bottom wall 5, end walls 6 and 7, and side walls 8. The container 1 may be sealed on opposing end walls 6 and 7 by end seals 9 and 10. The walls may define an article-receiving cavity 11. The container 1 may have an opening 12 in a wall. FIG. 1 illustrates placement of the opening 12 in the top wall 4. The container 1 may further comprise a closure flap 13. Alternate configurations of a closure flap 13 may be utilized and the closure flap 13 illustrated should not be considered a limiting configuration. The closure flap 13 may further comprise a tab 15. The tab 15 may assist the user in the opening and closing of the closure flap 13 of the container 1. The container 1 may comprise at least one substrate 17 within the article-receiving cavity 11. The body portion 2 may associate with at least one source 16 within the article-receiving cavity 11. FIG. 2 illustrates a cross-section view of the container of FIG. 1 taken along section line 2-2.

At least one source may be associated with the interior of at least one wall of a container, including, but not limited to, top, bottom, front, back, left, right, side, and end walls. The source may associate with the interior side of a movable lid or closure flap. The source may associate with the container in any configuration such that a portion, or all, of the source may be exposed to air, such as the air external to the container, when the container is in an open configuration. Such a configuration may increase the user's olfactory experience when the container is in an open configuration.

The amount of source that may be associated with the container may vary with the size of the container, the amount of headspace within the container, and the number and size of the articles contained therein. The container may be of any size suitable to provide an area for containing articles. The container may be from about 4 cm to about 40 cm in length; from about 2 cm to about 20 cm in width; and from about 0.5 cm to about 15 cm in height. The container may comprise greater than about 0.01, 0.1 or 1 g of the source. The container may comprise from about 0.01, 0.1 or 1 g to about 2, 4, 5, 8 or 10 g of the source.

The source may be any dimension deemed suitable for use in the container. The source may be from about 1, 2 or 3 cm to about 4, 5, 6, or 7 cm in length, from about 0.5, 0.7, or 1 cm to about 2 or 3 cm in width, and from about 0.001, 0.005, or 0.01 cm to about 0.05, 0.1, 0.5 or 1 cm in thickness. In an embodiment in which the source may be a hot melt adhesive, the source may be a stripe, such as a rectangular stripe. In such an embodiment, the source may be about 4 cm in length and about 1 cm in width. The source may be any thickness deemed suitable for the container. In an embodiment, the source may be greater than about 0.01 mm in thickness. The source may be from about 0.01, 0.05, 0.1 or 0.5 mm to about 0.7, 0.9, 1 or 2 mm in thickness.

The size and thickness of the source may affect the length of time over which the source releases the fragrance composition. Without being bound by theory, it is believed that the ratio of the volume to surface area of the source may affect the length of time that the source releases the fragrance composition. For example, two containers may comprise sources that are identical in volume but may differ in surface area. The source with the smaller surface area may have the ability to release the fragrance composition over a longer period of time. The source with a larger surface area may have the ability to release the fragrance composition over a shorter period of time. In such an example, therefore, it is believed that minimizing the volume to surface area ratio of the source, the length of time over which the fragrance composition expresses from the source may be increased.

The source may comprise a copolymer of ethylene with at least another monomer comprising at least one heteroatom. The source may comprise the copolymer of ethylene with at least another monomer comprising at least one heteroatom in an amount from about 5% or 10% to about 50% or 75% by weight of the source. All copolymers of ethylene with at least another monomer comprising at least one heteroatom are suitable for use herein. The term "monomer comprising at least one heteroatom" may include monomers which comprise at least a C—X linkage wherein X is not C or H. Said C—X linkage may be a polar linkage. The carbon atom may be linked to an N, S, F, Cl or O atom. The polar linkage may be part of a carbonyl group or of an ester group. Monomers comprising at least one heteroatom may include, but are not limited to, vinyl acetate, vinyl alcohol, methyl acrylate, ethyl acrylate, butyl acrylate, acrylic acid and salts formed therefrom, methacrylic acid and salts formed therefrom, maleic anhydride, glycidyl methacrylate and carbon monoxide. The monomer comprising at least one heteroatom may represent from about 10% to about 90% of the total weight of the copolymer.

Copolymers may include, but are not limited to, block and non-block copolymers, grafted copolymers, copolymers with side chains, crosslinked copolymers and copolymers where ethylene monomers may be randomly copolymerized with monomers comprising at least one heteroatom. Copolymers of ethylene may include, but are not limited to, ethylene-vinyl acetate copolymers, ethylene-vinyl ester copolymers, ethylene-acrylic ester copolymers, ethylene-methacrylic ester copolymers, ionomers, ethylene-acrylic acid copolymers, ethylene-methacrylic acid copolymers, ethylene-vinyl ester-acrylic acid copolymers, ethylene-vinyl ester-methacrylic acid copolymers, ethylene-vinyl ester-maleic anhydride copolymers, ethylene-acrylic ester-maleic anhydride copolymers, ethylene-vinyl ester-glycidyl methacrylate copolymers, ethylene-acrylic ester-glycidyl methacrylate copolymers, ethylene-maleic anhydride copolymers, and ethylene-glycidyl methacrylate copolymers.

The source may comprise a plasticizer, or mixture of plasticizers, comprising at least one heteroatom. The source may comprise the plasticizer comprising at least one heteroatom in an amount from about 5%, 10% or 15% to about 40% or 60% by weight of the source. The plasticizer may be compatible with the copolymer of ethylene with at least another monomer comprising at least one heteroatom. The term "plasticizer comprising at least one heteroatom" may include all those plasticizers which comprise at least a C—X linkage in the molecule wherein X is not C or H. Said C—X linkage may be a polar linkage. The carbon atom may be linked to an N, S, F, Cl or O atom. The polar linkage may be part of a carbonyl group or of an ester group.

The plasticizers may include, but are not limited to, citric acid esters, low molecular weight polyesters, polyethers, liquid rosin esters, aromatic sulfonamides, phthalates, benzoates, sucrose esters, derivatives of polyfunctional alcohols (where polyfunctional means having 2 or more hydroxyl groups), adipates, tartrates, sebacates, esters of phosphoric acid, fatty acids and diacids, fatty alcohols and diols, epoxidized vegetable oils and mixtures thereof.

The source may releasably comprise a fragrance composition. Without being bound by theory, it is believed that the fragrance composition may diffuse from the source under normal atmospheric conditions. The fragrance composition may comprise components including, but not limited to, benzenoid materials, alcohol materials, ester materials, aldehyde materials, ketone materials, natural materials, aromatherapy adjuvants, and mixtures thereof. These materials may be found in "Perfume and Flavor Chemicals", Vol. I and II, S. Arctander, Allured Publishing, 1994, ISBN 0-931710-35-5. The fragrance components may be employed at levels of from about 0.001%, 0.01%, 0.1%, 0.5%, or 1% to about 2%, 4%, 5%, or 10% by weight of the fragrance composition. The source may comprise the fragrance composition in an amount of more than about 5%, 10%, 20%, 30%, 40% or 50% by weight of the source. The fragrance composition may comprise less than about 80% or 90% by weight of the source. The source may comprise about 50% of fragrance composition by weight of the source. In an embodiment, a container may be about 5 cm in height, about 10 cm in width, and about 20 cm in length and may comprise about 1 g of the source. In such an embodiment, the source may comprise about 0.5 g of fragrance composition.

The benzenoid materials may include, but are not limited to, benzyl benzoate, benzyl carbinol, benzyl salicylate, benzyl cinnamate, diethyl phthalate, phenoxy ethanol, hexahydro-4,6,6,7,8,8-hexamethylcyclopenta-γ-2-benzopyran, 7-acetyl-1,1,3,4,4,6-hexamethyltetralin, 3-(3,4-methylene dioxyphenol)-2-methyl propanol, methyl-iso-eugenol, eugenol, and mixtures thereof.

The alcohol materials may include, but are not limited to, citronellol, alcohol C-8, alcohol C-10; alcohol C-11, alcohol C12, dipropylene glycol, linalool, geraniol, benzyl alcohol, 2-ethyl-4-(2,2,3-trimethyl-3-cyclopentene-1-yl)-2-buten-1-ol, dihydromyrcenol, and mixtures thereof.

Aldehydes may include, but are not limited to, C6-C14 aliphatic aldehydes, C6-C14 acyclic terpene aldehydes, and mixtures thereof. The aldehydes may be selected from C8-C12 aliphatic aldehydes, C8-C12 acyclic terpene aldehydes and mixtures thereof. The aldehydes may include, but are not limited to, citral; neral; iso-citral; dihydro citral; citronellal; octanal; nonanal; decanal; undecanal; dodecanal; tridecanal; 2-methyl decanal; methyl nonyl acetaldehyde; 2-nonenal; undecenal; undecylenic aldehyde; 2, 6 dimethyl octanal; 2, 6, 3, 10, trimethyl undecen-1-al; trimethyl undecanal; dodecenal; melonal; 2-methyl octanal; 3, 5, 5, trimethyl hexanal and mixtures thereof. The aldehyde materials may include, but are not limited to, from 4-(4-hydroxy-4-methylpentyl)-3-cyclohexene 1-carboxoaldehyde, p-t-butyl-α-methyldihydrocinnamic aldehyde, aldehyde C-10, aldehyde C-11, aldehyde C-12, laurinal, heliotropine, anisic aldehyde, benzyl aldehyde, and mixtures thereof.

The ester materials may include, but are not limited to, benzyl acetate, dimethyl benzyl carbinyl acetate, ethylene brassylate, cyclopentadecanolide, linalyl acetate, benzyl proprionate, citronellyl acetate, hexyl butyrate, neryl acetate, prenyl acetate, hexyl cinnamate, oxacyclohexadecen-2-one, and mixtures thereof.

The ketone materials may include, but are not limited to, methyl ionone, ambretone, methyl dihydro jasmonate, muscone, allyl ionone, and mixtures thereof.

The fragrance composition may comprise natural materials such as, but not limited to, aloe, apple, avocado, berry, calendula, chamomile, clovetree oil, coconut, eucalyptus, grapefruit, green tea, guava, honey, jojoba, kiwi, lavender, lemon, lemongrass, lime, mango, melon, milk, mint, orange, papaya, peach, pineapple, rose water, rosemary, sage, sandalwood, sunflower, sweet almond oil, tea tree oil, thyme, vanilla, vitamin C, vitamin E, zinc oxide, and combinations thereof.

The fragrance composition may comprise an aromatherapy adjuvant including, but not limited to, Anise Oil, Balm Mint Oil, Basil Oil, Bay Oil, Bee Balm Oil, Bergamot Oil, Cabbage Rose Oil, *Calendula Officinalis* Oil, Cardamon Oil, Cedarwood Oil, Chamomile Oil, Cinnamon Oil, Citronella Oil, Coriander Oil, Cypress Oil, *Eucalyptus Citriodora* Oil, *Eucalyptus Globulus* Oil, Gardenia Florida Oil, *Geranium Maculatum* Oil, Jasmine Oil, Lavender Oil, Lovage Oil, Mandarin Orange Oil, Musk Rose Oil, Myrrh Oil, Orange Flower Oil, Orange Oil, Passionflower Oil, Rosemary Oil, Rose Oil, Rose Hips Oil, Rosewood Oil, Sage Oil, Sweet Marjoram Oil, Sweet Violet Oil, Tea Tree Oil, Thyme Oil, and combinations thereof. Additional aromatherapy adjuvants may be found in US Publication No. 2005/0125923 by Benjamin et al.

The source may comprise optional components to further improve processability and mechanical characteristics, as well as other characteristics such as tackiness, resistance to ageing by light, oxygen and heat, and visual appearance. Such optional components may include, but are not limited to, copolymers of styrene and at least one other vinyl or acrylic monomer, copolymers of poly(vinyl alcohol), polyamides, polyether amide copolymers, polyester amide copolymers, polyesters, polyether ester copolymers, polyurethanes, polyethers, poly(2-ethyl-2-oxazoline), copolymers of poly(vinyl pyrrolidone), polyacrylates, copolymers of polyvinyl ethers), and combinations thereof.

In an embodiment in which the container comprises a flexible polymeric sheet, the source may also be flexible. Without being bound by theory, it is believed that flexibility of the source may assist the source in conforming to the movement of the container. For example, in a situation in which multiple flexible containers are stacked one of top of the other, the weight of the containers in the stack may cause the lowermost flexible container to deform in shape. It may be beneficial to have a flexible source that may conform to the deformed flexible container.

In an embodiment, the source may be a hot melt adhesive. Multiple processing techniques may produce a hot melt adhesive. For example, the selected polymer, plasticizer and fragrance composition can be blended together as a thermoplastic material. The resulting melt may be dispersed in water, such as at a temperature above its melting point, by mixing. Surfactant and/or stabilizing systems known to those skilled in the art can be employed to stabilize the resultant emulsion or dispersion.

In another embodiment, a preformed aqueous polymeric dispersion or emulsion can be blended with the selected plasticizer and fragrance composition. This may be done by adding the components directly to the polymeric dispersion or emulsion or by forming an aqueous dispersion of the fragrance composition and plasticizer and blending with the polymeric dispersion or emulsion.

In yet another embodiment, the polymeric dispersion can be formed in the presence of the plasticizer and/or the fragrance composition. This process can involve the solution or dispersion of monomers or prepolymers in water containing the dispersed fragrance composition and/or plasticizer. The polymerization can then be initiated to form the polymeric dispersion. If required, the fragrance composition or plasticizer can be added subsequently to produce a dispersed polymeric composition.

In an embodiment in which the source is a hot melt adhesive, the hot melt adhesive may be applied in the molten state onto a selected wall surface of the container and associated therewith. The hot melt adhesive may be applied to any inner surface of the container including, but not limited to, the inner surfaces of the top, bottom, front, back, side and end walls, closure flap, stationary cover, movable lid, and removable cover. Such application can be achieved during manufacture of the container. The hot melt adhesive can be applied by a conventional hot melt delivery system. This system may include a melting unit which maintains the hot melt at the temperature required to have a processable viscosity. The melting unit may contain a pumping system capable of pumping the hot melt through a length of hose until it reaches the glue gun or nozzle. The nozzle can have different geometries according to the desired application form of the glue (e.g., coatings, stripes, beads, etc). In one embodiment, a slot nozzle can be used as the glue gun.

Non-limiting examples suitable to make the source may be found in US Publication No. 2005/0272624 by Hardy et al.

Figure 3:
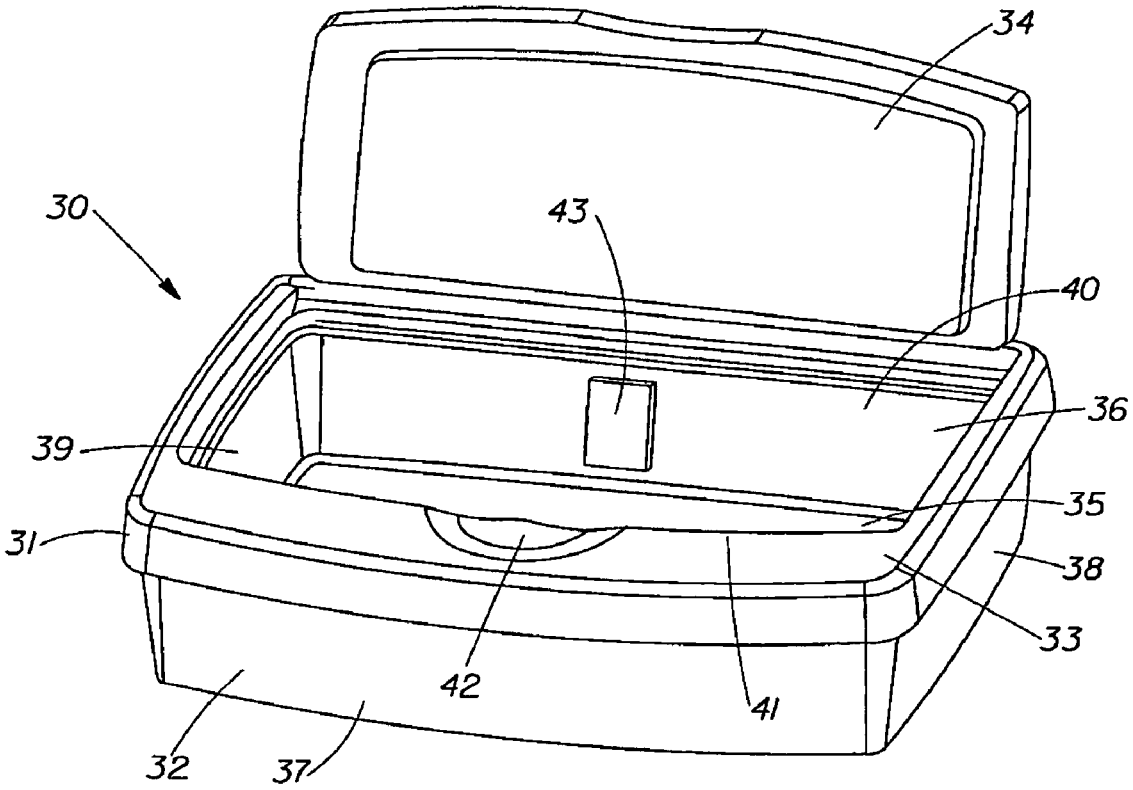
FIG. 3 is a perspective view of an alternate embodiment of a container.

FIG. 3 illustrates an alternate embodiment of a container 30 comprising a closing device 31 which fits onto, or is a part of, a container body 32. The closing device 31 may comprise a stationary cover 33 and a movable lid 34. The container body 32 may comprise bottom 35, back 36, front 37, right side 38 and left side 39 walls defining a substantially parallelepipedic article-receiving cavity 40. The container body's movable lid 34 may be open so as to define an opening 41. The container 30 may further comprise a push button 42. The container 30 may associate with at least one source 43 within the article-receiving cavity 40.

Figure 4:
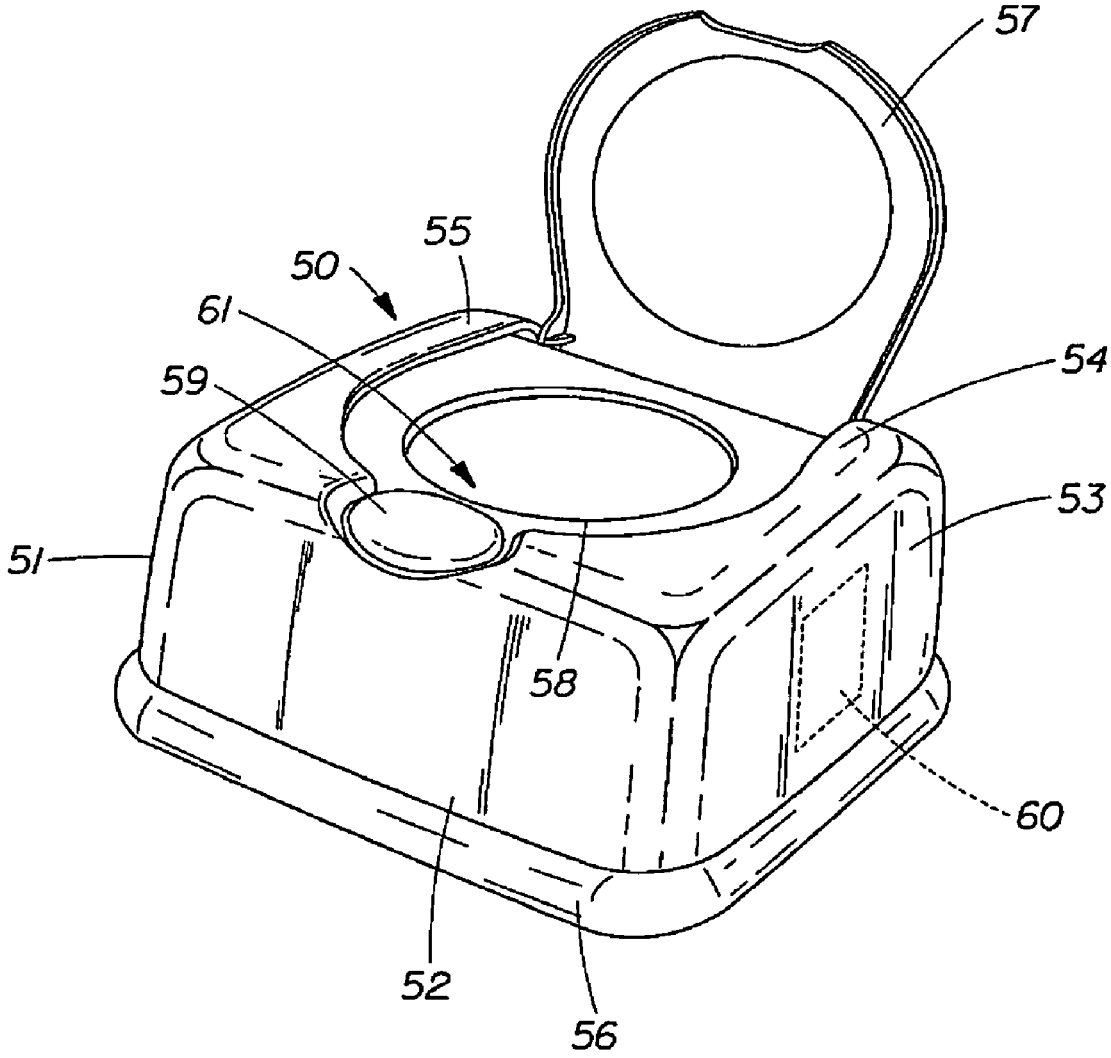
FIG. 4 is a perspective view of an alternate embodiment of a container.

FIG. 4 illustrates another embodiment of a container 50. The container body 51 may comprise back, front 52, right 53 and left side walls defining an article-receiving cavity 61. A stationary cover 54 may be integrally molded with said container body 51, such as to form a top wall 55, and a bottom of said container may be open so as to constitute a refill opening. A removable, and possibly flexible, cover 56 may be fitted onto said refill opening. A moveable lid 57 may be associated with the stationary cover 54 and may cover an opening 58. The container 50 may further comprise a push button 59. The container 50 may associate with at least one source 60 within the article-receiving cavity 61.

Figure 5:
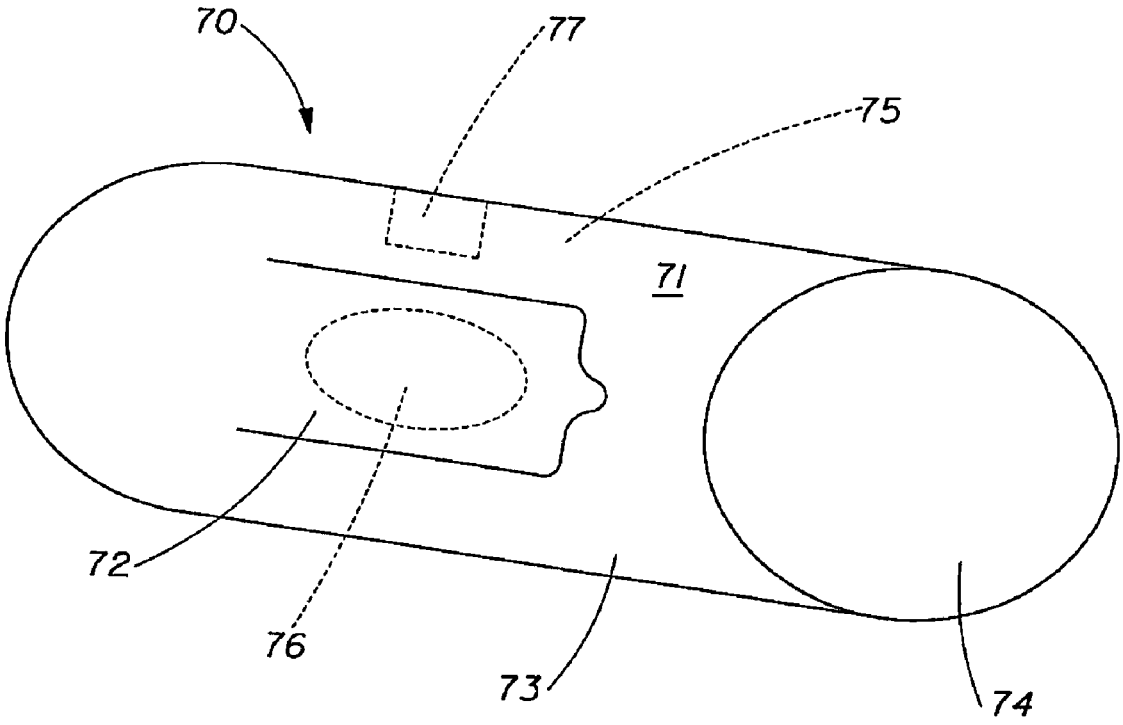
FIG. 5 is a perspective view of an alternate embodiment of a container.

FIG. 5 illustrates an embodiment of a container 70 in a cylindrical shape. The container 70 may comprise a flexible polymeric sheet 71. The container 70 may comprise a wall 73 defining an article-receiving cavity 75. The container may also comprise an end wall, such as end wall 74. The container may comprise an opening 76 in the wall 73. The opening 76 may be covered by a closure flap 72. The opening 76 may be located in alternate locations of the container 70 such as end wall 74. The container 70 may associate with at least one source 77 within the article-receiving cavity 75.

The container may be molded from a polypropylene material or any other suitable thermoplastic materials such as polyethylene, polystyrene, acrylonitryl butadiene styrene (ABS), polyester, polyvinyl chloride, polycarbonate or elastomer, or a blend of these compounds. It should be recognized that FIGS. 1-5 are non-limiting examples of containers. Additional details of the description of containers may be found in U.S. Pat. No. 6,902,077 issued to Tack et al., Jun. 7, 2005 and US Publication No. 2005/0139598 by Tack et al., Jun. 30, 2005.

Substrate

The contents of the container may be any consumer article. The contents may be any article such as a substrate for body care or household cleaning purposes. The substrate may be a nonwoven material. The substrate may be either wet or dry. The fibers of the substrate may be any natural, cellulosic, and/or synthetic material such as polymeric material. The natural fibers may be treated or otherwise modified mechanically or chemically to provide desired characteristics or may be in a form that is generally similar to the form in which they can be found in nature. Any or all of the synthetic fibers may be treated before, during, or after manufacture to change any desired properties of the fibers.

In certain embodiments, it may be desirable to have particular combinations of fibers to provide desired characteristics. For example, it may be desirable to have fibers of certain lengths, widths, coarseness or other characteristics combined in certain layers or separate from each other. The fibers may be of virtually any size and preferably have an average length from about 1 mm to about 60 mm. Average fiber length refers to the length of the individual fibers if straightened out. The fibers may have an average fiber width of greater than about 5 micrometers. The fibers may have an average fiber width of from about 5 micrometers to about 50 micrometers. The fibers may have a coarseness of greater than about 5 mg/100 m. The fibers may have a coarseness of from about 5 mg/100 m to about 75 mg/100 m.

The fibers may be circular in cross-section, dog-bone shape, delta (i.e., triangular cross section), trilobal, ribbon, or other shapes typically produced as staple fibers. Likewise, the fibers can be conjugate fibers such as bicomponent fibers. The fibers may be crimped and may have a finish, such as a lubricant, applied.

The substrate materials may be treated to improve the softness and texture thereof. The substrate may be subjected to various treatments, such as, but not limited to, physical treatment, such as, but not limited to, ring rolling, structural elongation, consolidation, stretch aperturing, differential elongation, and other solid state formation technologies, and zone activation; chemical treatment, such as, but not limited to, rendering part or all of the substrate hydrophobic and/or hydrophilic; thermal treatment, such as, but not limited to, softening of fibers by heating, thermal bonding; and combinations thereof.

The substrate may have a basis weight between about 15, 30, 40, 45, 65, 75, or 100 grams/$m^2$ and about 200, 300, 400 or 500 grams/$m^2$. A suitable substrate may be a carded nonwoven comprising a 40/60 blend of viscose fibers and polypropylene fibers having a basis weight of 58 grams/$m^2$ as available from Suominen of Tampere, Finland as FIBRELLA™ 3160. FIBRELLA™ 3160 is a 58 grams/$m^2$ nonwoven web comprising 60% w/w 1.5 denier polypropylene fibers and 40% w/w 1.5 denier viscose fibers. Another suitable material may be FIBRELLA™ 3100 which is a 62 grams/$m^2$ nonwoven web comprising 50% w/w 1.5 denier polypropylene fibers and 50% w/w 1.5 denier viscose fibers. In both of these commercially available fibrous webs, the average fiber length is about 38 mm. Another suitable material for use as a substrate may be SAWATEX™ 2642 as available from Sandier AG of Schwarzenbach/Salle, Germany. Yet another suitable material for use as a substrate may have a basis weight of from about 50 grams/$m^2$ to about 60 grams/$m^2$ and have a 20/80 blend of viscose fibers and polypropylene fibers. The substrate may be a 60/40 blend of pulp and viscose fibers.

Substrates may be generally of sufficient dimension to allow for convenient handling. Typically, the substrate may be cut and/or folded to such dimensions as part of the manufacturing process. In some instances, the substrate may be cut into individual portions so as to provide separate wipes which are often stacked and interleaved in consumer packaging. In other embodiments, the substrates may be in a web form where the web has been slit and folded to a predetermined width and provided with means (e.g., perforations) to allow individual wipes to be separated from the web by a user. An individual substrate may have a length between about 100 mm and about 300 mm and a width between about 100 mm and about 250 mm. In one embodiment, the substrate may be about 200 mm long and about 180 mm wide.

In one embodiment, the surface of substrate may be essentially flat. In another embodiment, the surface of the substrate may contain raised and/or lowered portions. These can be in the form of logos, indicia, trademarks, geometric patterns, images of the surfaces that the substrate is intended to clean (i.e., infant's body, face, etc.). They may be randomly arranged on the surface of the substrate or be in a repetitive pattern. In another embodiment, the substrate may be biodegradable. For example, the substrate may comprise a biodegradable material such as a polyesteramide, or a high wet strength cellulose.

Composition

The substrate may associate with a composition. The composition may generally comprise the following optional components: emollients, surfactants, rheology modifiers, preservatives, or a combination of preservative compounds acting together as a preservative system, and water. Other components may be incorporated into the composition, including, but not limited to, soothing agents, vitamins, minerals, antioxidants, moisturizers, botanicals, fragrances, potentiators, aesthetic enhancing ingredients, texturizers, colorants, medically active ingredients, such as healing actives and skin protectants and additional skin health benefit ingredients. It is to be noted that some components can have a multiple function and that all components are not necessarily present in the composition. The composition may be an oil-in-water emulsion. The pH of the composition may be from about pH 3, 4 or 5 to about pH 7, 7.5, or 9. The composition may have a water content level of greater than about 50%, 60%, 70% or 85%. The composition may have a water content less than about 25%, 15%, or 10% for use with a primarily dry substrate.

Emollients may include silicone oils, functionalized silicone oils, hydrocarbon oils, fatty alcohols, fatty alcohol ethers, fatty acids, esters of monobasic and/or dibasic and/or tribasic and/or polybasic carboxylic acids with mono and polyhydric alcohols, polyoxyethylenes, polyoxypropylenes, mixtures of polyoxyethylene and polyoxypropylene ethers of fatty alcohols, and mixtures thereof. The emollients may be either saturated or unsaturated, have an aliphatic character and be straight or branched chained or contain alicyclic or aromatic rings. An example of an emollient is caprylic capric triglycerides in combination with Bis-PEG/PPG-16/16 PEG/PPG-16/16 dimethicone known as ABIL CARE™ 85 (available from Degussa Care Specialties of Hopewell, Va.). Emollients, when present, may be used at a weight/weight % (w/w) of the composition from about 0.5%, 1% or 4% to about 0.001%, 0.01%, or 0.02% w/w.

The surfactant can be an individual surfactant or a mixture of surfactants. The surfactant may be a polymeric surfactant or a non-polymeric one. The surfactant may be employed as an emulsifier. The surfactant, when present, may be employed in an amount effective to emulsify the emollient and any other non-water-soluble oils that may be present in the composition, such as an amount ranging from about 0.5%, 1%, or 4% w/w to about 0.001%, 0.01% or 0.02% w/w (based on the weight surfactant over the weight of the composition).

The composition may include one or more surfactants. The surfactant or combinations of surfactants may be mild, which means that the surfactants provide sufficient cleansing or detersive benefits but do not overly dry or otherwise harm or damage the skin. The surfactant may include those selected from the group consisting of anionic surfactants, nonionic surfactants, cationic surfactants, amphoteric surfactants, zwitterionic surfactants, and mixtures thereof.

Examples of rheology modifiers include, but are not limited to, Ultrez™-10, a carbomer, and Pemulen™ TR-2, an acrylate crosspolymer, both of which are available from Noveon, Cleveland Ohio, and Keltrol™, a Xanthan gum, available from CP Kelco, San Diego Calif., and combinations thereof. Rheology modifiers, when present, may be used at a weight/weight % (w/w) of the composition from about 0.01%, 0.015%, or 0.02% to about 1%, 2% or 3%.

The lotion composition may comprise a preservative or a combination of preservatives acting together as a preservative system. A preservative may be understood to be a chemical or natural compound or a combination of compounds reducing the growth of microorganisms. Materials useful as preservatives include, but are not limited to: methylol compounds, iodopropynyl compounds, simple aromatic alcohols, paraben compounds, chelators such as ethylenediamine tetraacetic acid, and combinations thereof.

The composition may comprise a fragrance. The fragrance may be the same as the fragrance composition comprised by the source located within the article-receiving cavity of the container. In an embodiment, the fragrance may be different from the fragrance composition comprised by the source. In such an embodiment, the fragrance composition comprised by the source and the fragrance comprised by the composition may be complimentary.

Additional details on the substrate and composition may be found in U.S. Pat. No. 6,716,805 issued to Sherry et al.; US Publication Nos. 2003/0126709 by Policicchio et al., 2005/0081888 by Pung et al., and 2006/0177488 by Caruso et al.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A closed container comprising:

a. a closed container body comprising a wall, said body defining an article-receiving cavity, wherein said wall comprises an interior surface facing towards said article-receiving cavity;

b. a source associated with a portion of said interior surface of said wall, said source releasably comprising a fragrance composition; and c. at least one fibrous substrate located within said article-receiving cavity, wherein said at least one fibrous substrate comprises a nonwoven material, wherein said at least one fibrous substrate comprises a composition comprising at least about 60% by weight of water;

wherein said fragrance composition diffuses into said article-receiving cavity.

2. The container of claim 1 wherein said fragrance composition transfers to said at least one substrate.

3. The container of claim 1 wherein said source comprises from about 5% to about 90% of said fragrance composition by weight of said source.

4. The container of claim 1 wherein said fragrance composition comprises aldehydes, ketones, alcohols, benzoids, esters or combinations thereof.

5. The container of claim 1 wherein said fragrance composition comprises aromatherapy adjuvants, natural materials or combinations thereof.

6. The container of claim 1 wherein said source is a hot melt adhesive.

7. The container of claim 6 wherein said hot melt adhesive comprises:

a. a copolymer of ethylene with at least another monomer comprising at least one heteroatom, and b. greater than about 10% of a plasticizer comprising at least one heteroatom.

8. The container of claim 7 wherein said monomer comprising at least one heteroatom comprises a carbonyl group.

9. The container of claim 7 wherein said monomer comprising at least one heteroatom comprises an ester group.

10. The container of claim 7 wherein said plasticizer is selected from the group consisting of citric acid esters, low molecular weight polyesters, polyethers, rosin esters, aromatic sulfonamides, phthalates, benzoates, sucrose esters, derivatives of polyfunctional alcohols, adipates, tartrates, sebacates, esters of phosphoric acids, fatty acids, fatty diacids, fatty alcohols, fatty diols, epoxidised vegetable oils, and combinations thereof.

11. The container of claim 7 wherein said copolymer is an ethylene-vinylacetate copolymer.

12. The container of claim 7 wherein said copolymer is from about 5% to about 75% by weight of said hot melt adhesive.

13. The container of claim 7 wherein said plasticizer is from about 10% to about 60% by weight of said hot melt adhesive.

14. The container of claim 1 wherein said substrate is associated with a composition.

15. The container of claim 14 wherein said composition comprises a fragrance.

16. The container of claim 15 wherein said fragrance is complimentary to said fragrance composition releasably comprised by said source.

17. The container of claim 1 wherein said source is flexible.

18. A container comprising:

a. a container body comprising a wall, said body defining an article-receiving cavity, wherein said wall comprises an interior surface facing towards said article-receiving cavity;

b. a source associated with a portion of said interior surface of said wall, said source releasably comprising a fragrance composition; and c. at least one nonwoven fibrous substrate located within said article-receiving cavity, wherein said at least one nonwoven fibrous substrate is impregnated with a composition comprising at least about 70% by weight of water;

wherein said fragrance composition diffuses into said article-receiving cavity.

* * * * *

UNITED STATES PATENT AND TRADEMARK OFFICE

CERTIFICATE OF CORRECTION

PATENT NO. : 7,850,038 B2
APPLICATION NO. : 11/710218
DATED : December 14, 2010
INVENTOR(S) : Joerg Mueller et al.

It is certified that error appears in the above-identified patent and that said Letters Patent is hereby corrected as shown below:

Column 8

Line 66, delete “Sandier” and insert --Sandler--.

Column 11

Line 25, delete “benzoids”.

Signed and Sealed this
Eighteenth Day of October, 2011

David J. Kappos

David J. Kappos
*Director of the United States Patent and Trademark Office*